United States Patent [19]

Cohen et al.

[11] 4,013,292

[45] Mar. 22, 1977

[54] AUTOMATIC BASKETBALL GAME HAVING SCORING INDICATOR AND TIME LIMITATION

[75] Inventors: Monroe Cohen, Brooklyn; Gale Dorothea, Queens, both of N.Y.

[73] Assignee: Shoot The Hoops, Inc., Brooklyn, N.Y.

[22] Filed: Sept. 22, 1975

[21] Appl. No.: 615,876

Related U.S. Application Data

[63] Continuation-in-part of Ser. No. 437,149, Jan. 28, 1974, abandoned.

[52] U.S. Cl. ..... 273/102.2 R; 273/95 D

[51] Int. Cl.[2] ..... A63B 67/00

[58] Field of Search ..... 194/9 T; 273/1 E, 26 C, 273/29 A, 95 R, 95 D, 101.1, 101.2, 102.2 R, 85 R, 102.1 G, 201, 11 C, 30; 272/65

[56] References Cited

UNITED STATES PATENTS

| | | | |
|---|---|---|---|
| 2,109,860 | 3/1938 | Dahlstrom | 194/9 T |
| 2,259,916 | 10/1941 | Wheeler | 273/201 |
| 2,541,266 | 2/1951 | Metz | 273/95 C |
| 2,845,270 | 7/1958 | Durant | 273/101.2 |
| 2,893,734 | 2/1959 | Tarte | 273/85 R |
| 3,294,402 | 12/1966 | Scott | 273/201 |
| 3,358,995 | 12/1967 | Braun | 273/11 C |
| 3,362,712 | 1/1968 | Wagner | 273/95 R |
| 3,635,471 | 1/1972 | Caron | 272/65 |
| 3,817,519 | 6/1974 | Leonhart | 273/30 |

*Primary Examiner*—Delbert B. Lowe
*Attorney, Agent, or Firm*—Allen D. Brufsky

[57] ABSTRACT

A basketball game having a coin operated switch to release basketballs to a player and to initiate a timing circuit. The player attempts to convert as many baskets as possible during the time interval of the game. The basketball hoop has means to indicate when a score has been made. Visual display means are provided to indicate the score made, the time interval remaining in which the player can attempt to score and the number of successively won games. In one embodiment, the game ends when the time interval expires. In another embodiment, the game ends when the time interval expires or when a predetermined number of balls have been thrown, whichever occurs first. Solid state circuits may reset the game for free rounds of play and control the dispensing of prize tickets as a function of the game score and of the number of successively won games.

8 Claims, 10 Drawing Figures

ENABLE BASKET SWITCH
START COUNT DOWN
FROM RESET LOGIC 29
FREE GAME
FROM RESET LOGIC 29
START GAME
DECODER
CLOCK
CLEAR
SET
PULSE GEN.
SHOOT LIGHT
COIN ACCEPT
BALL RELEASE
GAME OVER
+5

COUNTDOWN CLOCK DISPLAY
ONES
TENS
0
1
2
3
4
5
6
7
8
9
10
11
12
13
14
15
BCD TO DECIMAL DECODER/DRIVER
117
118
119
121
120
TIME OVER
SENSE
WIN
50
START
39
+5
116
SELF DRIVING BINARY COUNTER TRIG

AUTOMATIC BASKETBALL GAME HAVING SCORING INDICATOR AND TIME LIMITATION

CROSS REFERENCE

This application is a continuation-in-part of U.S. Application S.N. 437,149, filed Jan. 28, 1974, now abandoned.

BACKGROUND OF THE INVENTION

This invention relates to a basketball game, and more particularly, to a coin-operated basketball game which may be installed in an amusement park, or other outdoor or indoor recreational facility. By reducing the mechanical and physical dimensions of the game and using a smaller basketball, the game could be played indoors in cocktail lounges where related types of devices are presently installed.

The game of basketball is the only major world sport invented and developed in the United States. In recent years, it has attained immense popularity through television coverage of college and professional games. At amusement parks and fairs, baskets have been set up where for a fixed sum three shots are taken, the ball being retrieved by the attendant and given to the player.

Other variations have been devised as in U.S. Pat. No. 3,362,712 where three baskets are secured to a backboard to retain three balls used in the game. The baskets may be colored red, white and blue and the balls with the same colors are to be scored in the correspondingly colored baskets which have retaining springs. In U.S. Pat. No. 3,137,503 a commercial basketball game is disclosed having a playing field thirty feet by thirty-five feet sectioned into squares. A plurality of differently colored and numbered circles are located about the field. The backboard supporting the basket has similarly disposed spot indicators which are illuminated in sequence at timed intervals to direct the player as to which spot on the floor he is to shoot at the basket.

The present invention is completely different and has as its objective to place a premium on quickness and accuracy, simulating game conditions where an open shot may exist only for seconds. The player, depending on his adeptness, is to execute as many accurate shots during a specific time limit as possible.

The time of the game and the number of balls delivered can be changed. For example, the game can be designed to deliver three balls and the time limit set at fifteen seconds. A Game Over light flashes on the scoreboard at the fifteen second position. A ball thrown after that will not register.

SUMMARY OF THE INVENTION

Accordingly, this invention relates to a basketball game which may be installed in an amusement park or outside a mobile trailer, cocktail lounge or the like. The player will have available a predetermined number of basketballs to shoot within a predetermined time period. Baskets scored will be indicated by electrical means and shown on a counter while a countdown timer to indicate remaining time available to shoot will also be observable by the player.

The primary object of this invention is to provide a basketball game testing the accuracy and quickness of a player in scoring a predetermined number of baskets within a given time period.

A further object is to provide such a game with automatic controls so as to require little or no attention by an attendant.

A further object is to provide a basketball game readily adjustable to varying space limitations.

A further object is to provide a basketball game readily adjustable to simulate different playing conditions.

The objects are accomplished by a basketball game having a coin-operated switch to release a quantity of basketballs to a player and initiate a timing circuit. The basketball hoop has means to indicate when a score has been made. A solenoid or other escapement releases the basketballs to the player who may score as many baskets as possible within such time limit. As further inducement, coupons can be automatically dispensed as a function of game score and number of games won. The coupons may be redeemed for a prize.

Other objects will be apparent from the following specification and drawings, in which:

DETAILED DESCRIPTION OF THE PREFERRED EMBODIMENT

Figure 1:
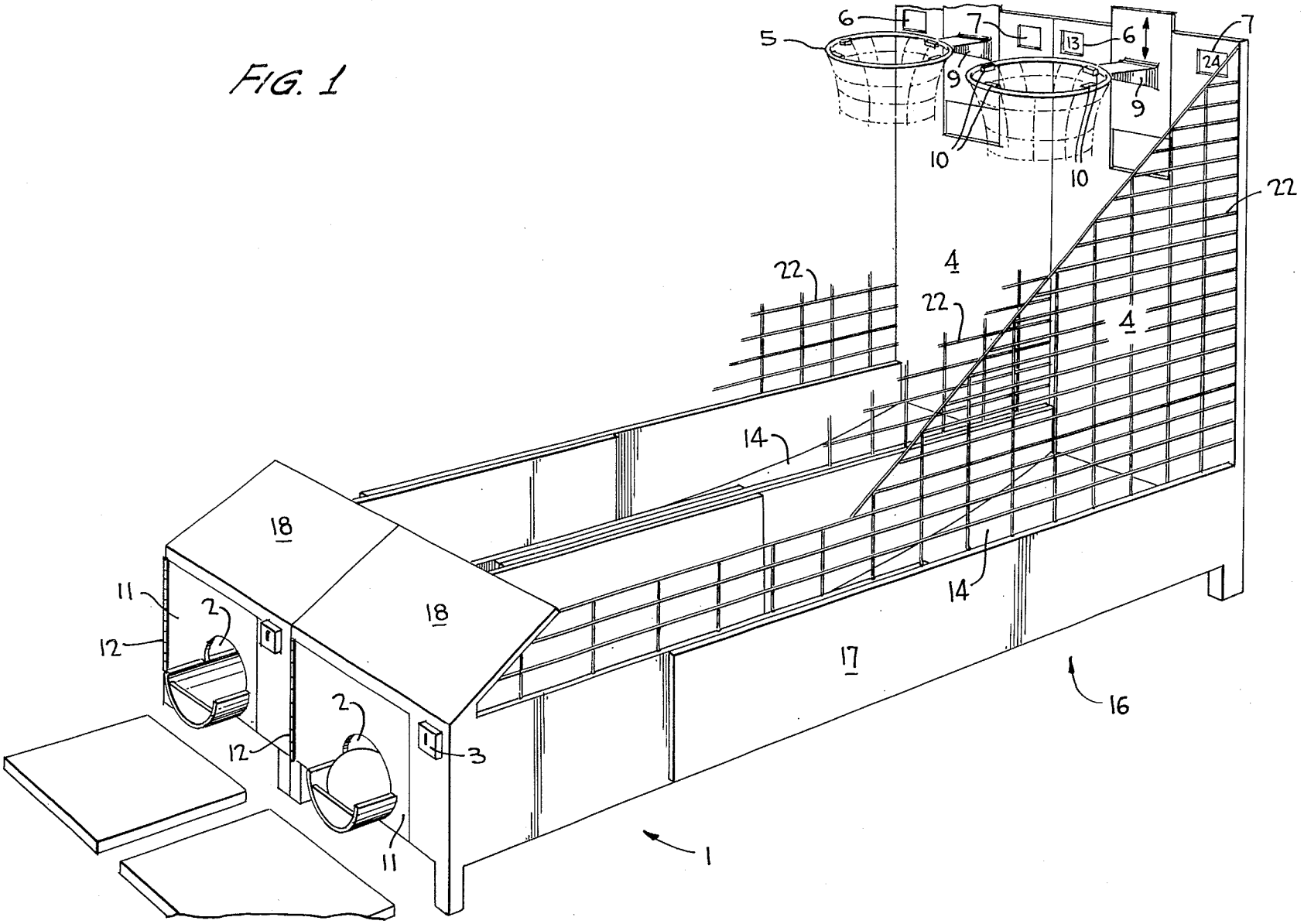
FIG. 1 is a perspective view of the complete game apparatus.

Referring now to the drawings in detail, 1 represents the front area of the game apparatus 17 where basketballs 13 are stored, 2 the ball dispensing opening which may be approximately 15 inches in diameter, and 3 a coin box for initiating the game. A backboard 4 at the rear 16 of the apparatus 17 supports a ring 5, known as the "basket," a score indicator 6 and a time indicator 7.

To register scores, a photoelectric sensing system can be suspended from the ring 5 by supports 9. Alternatively, a single microswitch with a long sensing finger or a plurality of microswitches 10 may be mounted to extend within the perimeter of the ring 5 so as to contact and register a ball passing through, no matter the angle of entry.

The game apparatus 17 may consist of one or more individual games, as illustrated in FIG. 1, and each game may have dimensions of three feet width and a distance to the basket of up to fifteen feet, the regulation foul shooting distance, as determined by available space.

Figure 2:
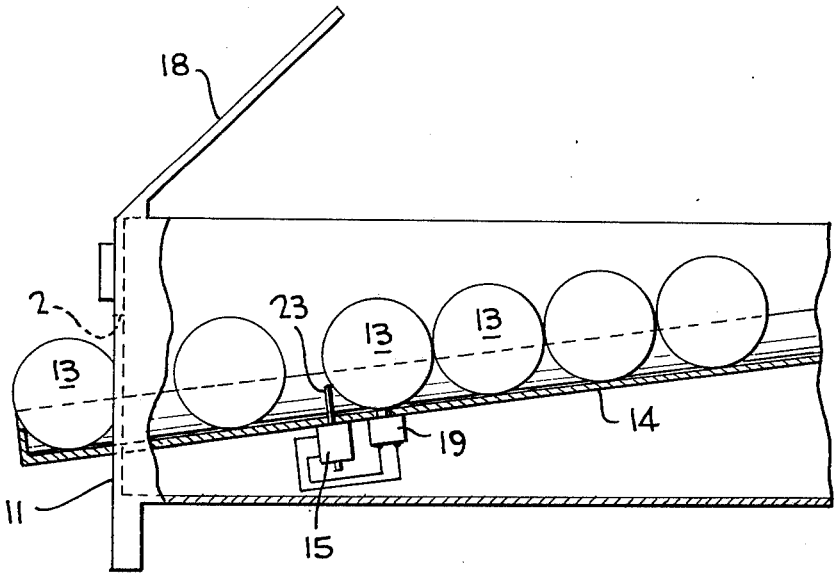
FIG. 2 is a fragmentary side view in the elevation of the ball dispensing area of the apparatus shown in FIG. 1, with certain portions shown in section and the side wall omitted for purposes of illustration.

A door 11 with hinge 12 provides access to the electrical equipment and ball storage space in each game. The balls 13 are fed by gravity on an inclined hopper 14 leading to the opening 2 as shown in FIG. 2. A solenoid or other escapement device 15 retains the balls 13 on hopper 14 until released by a coin-operated switch 20 and then is activated to restrain the balls at the expiration of the time set on timer 21 or after a predetermined number of balls pass by on the hopper ramp. Nets 22 or canvas are used at the sides and overhead to retain the balls in the playing area and help return them to the hopper.

A ticket dispenser can be located to the left of the ball dispensing opening 2. Between the score indicator 6 and the time indicator 7 will be a GAME OVER display. The ring 5 can be 15 to 18 inches in diameter and 6 to 10 feet above the ground depending upon the distance the player will be shooting from. A shield 18, approximately 3 feet long, as shown in FIGS. 1 and 2, conceals the balls flowing into the dispensing opening 2.

A microswitch 19 with a counter or other like device may, in one embodiment by activated after a predetermined number of balls 13, for example three, pass by on the inclined hopper 15. Microswitch 19 will then activate the solenoid 15 to block the next ball.

Figure 3:
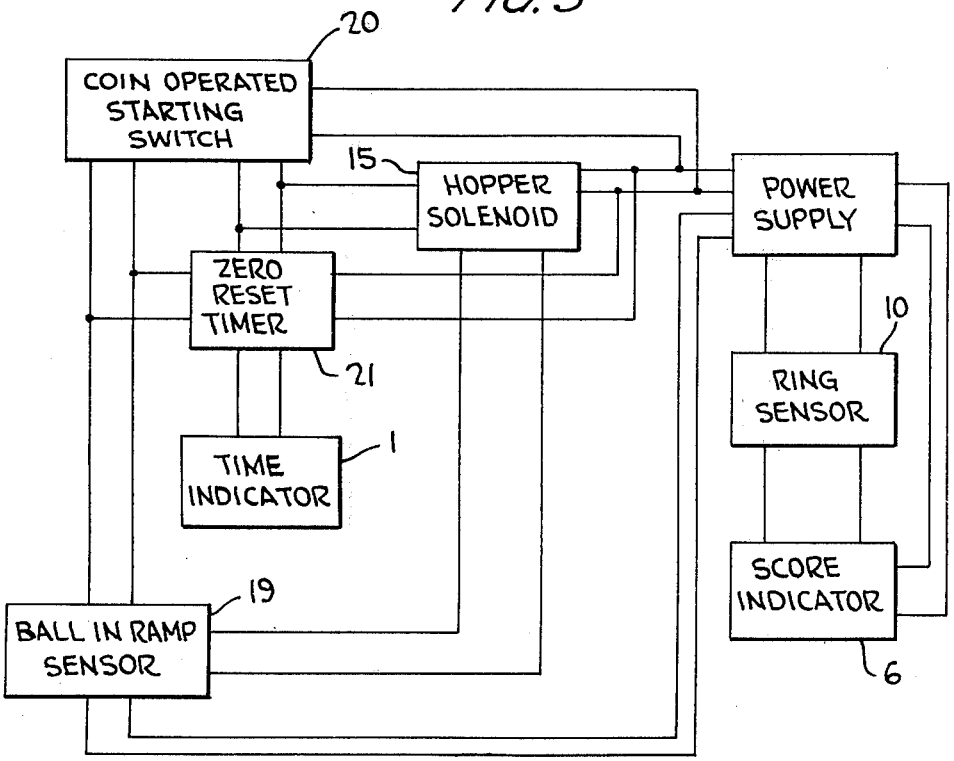
FIG. 3 is a block diagram of the electrical circuit incorporated in the game apparatus.

In the electrical circuit block diagram of FIG. 3, conventional electrical components are used to activate the various elements of the apparatus 17. Coinoperated switch 20 activates zero reset timer 21, the time being shown by indicator 7. At the same time, hopper solenoid 15 or other escapement device is activated to retract its plunger 23 to release the balls 13 and power is supplied to the ring sensors or microswitches 10 and score indicator 6. When time expires, solenoid 15 or other escapement device returns its plunger 23 to its ball restraining position. Similarly, after a predetermined number of balls are sensed by ramp sensor or microswitch 19 on the hopper ramp 14, plunger 23 of solenoid 15 is extended to prevent any further balls 13 from being dispensed.

To accommodate the game either to the interior of a trailer or to a larger outside stall at a fair, the backboard may be made adjustable for varying the height of the hoop. Similarly, the side walls may be made adjustable to vary the distance between player and hoop.

Other variations to afford amusement to the basic skills required may involve providing a slow up and down movement of the hoop through a motor, gearing and cam attached to the hoop through the back of the backboard with the requisite slot in the latter for such movements. Similarly, the platform upon which the player stands may be constructed to shift from side to side. Movements of hoop and platform may be operated alternatively or simultaneously.

Thus it is apparent that a player will be able to shoot a predetermined number of balls within a set time limit while a record is kept of baskets scored and the time interval remaining in which to shoot. A number of such games could be supervised by a single attendant.

In another embodiment of the invention, a predetermined number of balls are delivered to a player. The player has a certain amount of time within which to shoot or throw those balls at a target, such as the basket. When the predetermined number of balls has been thrown or the time has elapsed, whichever occurs first, the game is reset. In this embodiment, tickets may be dispensed under the control of logic circuitry. The number of tickets dispensed is a function of the score within the current game and the number of successively-won games.

Figure 4:
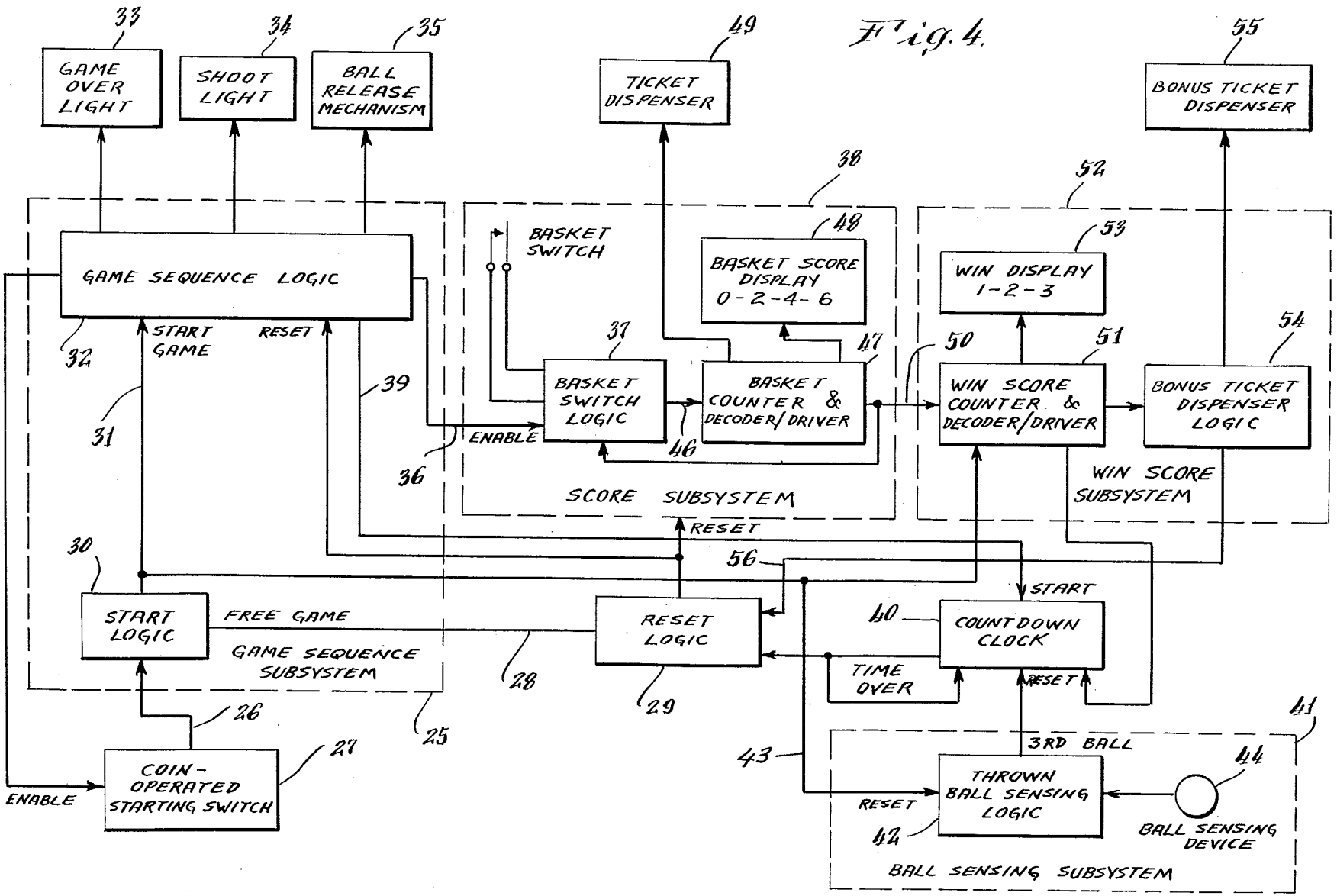
FIG. 4 is a block diagram of a control system for another embodiment of the invention in which a predetermined number of basketballs is dispensed during each game.

Referring now to FIG. 4, a control system for this embodiment includes a game sequence subsystem 25 which can be triggered by a signal produced on an input 26 from a coin-operated switch 27. The game sequence subsystem 25 includes start logic 30 having the input 26 and a second input 28 from reset logic 29. Under certain conditions, described in detail later, reset logic 29 generates a signal on input 28 which has the same affect on start logic 30 as a signal provided by the coin-operated starting switch 27. Start logic 30 produces a start pulse which is applied to game sequence logic 32 over lead 31.

The game sequence logic 32 serves several functions. Logic 32 controls the coin-operated starting switch 27, a Game Over light 33, a Shoot Light 34 and ball release mechanism 35. This mechanism may be a conventional one, such as a walking beam escapement mechanism, which will deliver a predetermined number of balls to a player. In the embodiment described below, it is assumed that three balls will be delivered to a player.

Game sequence logic 32 also produces an enabling signal on a lead 36 to basket switch logic 37 in a score subsystem 38. Finally, after a time delay sufficient to allow balls to be physically transported to the player, game sequence logic 32 generates a start signal which is applied through a lead 39 to activate a countdown clock 40.

The countdown clock 40 can count through a fixed time period representing the maximum time allowed a player in which to shoot all of the balls delivered to him. Where three balls are delivered, the clock 40 might count through a 15 second period.

Countdown clock 40 automatically resets at the first to occur of three different events, whether or not the 15 seconds have elapsed. The clock is reset when a player has thrown all three balls delivered to him regardless of score attained or when the player has achieved a winning score within a game or when the clock has timed out or counted through full 15 second period without either of the other two events occurring first.

The number of balls thrown by a player is detected by a ball sensing subsystem 41 having logic 42 which is reset at the beginning of each game by a reset signal on input 43. The logic 42 is connected to a ball sensing device 44 which might be a pressure sensitive switch located at the ball return surface or floor of the game. The ball sensing subsystem 41 counts the number of balls thrown by a player. When all balls have been thrown, the subsystem causes the clock 40 to be reset as if it had timed out which, in turn, causes the entire game to be reset. Therefore, if a player throws his balls in much less than the maximum allotted time, the game is automatically made ready for the next player without remaining idle.

The number of baskets scored within the game, is registered within the score subsystem 38. The passage of the ball through the ring is, as was discussed earlier, detected by one or more switches mounted on or near the ring. For purposes of illustration, a single basket switch 45 is shown. The temporary closure of the basket switch 45 causes a signal to be applied to the basket switch logic 37 which, if enabled, generates an output pulse on lead 46 to a basket counter and decoder/-driver circuit 47. The basket counter and decoder/-driver circuit 47 includes a binary counter which stores a binary representation of the number of baskets scored within the game. The binary representation is applied to a decoder which converts the representation to decimal format. The decimal format is used to drive a basket score display panel 48. The circuit 47 may also provide control signals to a ticket dispenser 49. Ticket dispenser 49 may be a conventional device programmed to deliver one ticket for each input control pulse. Tickets dispensed by dispenser 49 and by a bonus ticket dispenser 55 are normally redeemable for prizes or free games.

The basket counter and decoder/driver circuit 47 has an output lead 50 for a win-indicating signal. A "win" can be defined in different ways. In a basketball game, a win could be defined as a perfect game; that is, three baskets in a row with three balls having been dispensed to the player. The win-indicating signal on lead 50 is applied to a win score counter and decoder/driver circuit 51 in a win score subsystem 52. The win score counter is a binary counter for establishing a binary representation of the number of games won in succession. The binary representation is decoded to a decimal format signal which is employed to drive a win display panel 53.

The circuit 51 also provides control signals for bonus ticket dispenser logic 54. Logic 54 controls the bonus ticket dispenser 55 to provide different numbers of bonus tickets as a function of the number of successively-won games. As an example, one bonus ticket might be dispensed for a single perfect game, two might be dispensed for two perfect games in a row and three might be dispensed for three perfect games in a row.

Logic 54 provides a signal on lead 56 to the reset logic 29 which indicates when three perfect games in a row have occurred. Reset logic 29 responds to this signal to prevent an award of further free games.

The control system described above operates in the following generally-described manner.

When power is first applied to the game, all logic is driven to a reset state. The displays are set to indicate a ready-to-play condition; for example, the basket score display 48 is set to display a score of zero.

When a coin is inserted into the coin-operated starting switch 27, the start logic 30 applies a start signal to the game sequence logic 32. The Game Over light is turned off, the ball release mechanism is activated, and the coin-operated switch is disabled to prevent insertion of addition coins during the game. After a delay of several seconds, during which time the balls are delivered to the player, the game sequence logic 32 signals the countdown clock 40 to begin the count through the fifteen second time period. At the same time, the Shoot Light is energized to alert a player that he may begin shooting. The ball release mechanism 35 is concurrently reset in preparation for the next game.

The player attempts to make three baskets with the three balls dispensed to him. For each basket made, the score subsystem 38 increments the displayed score while causing a predetermined number of tickets to be dispensed by ticket dispenser 49.

If the player wins the game by scoring with all three balls within the predetermined time period, the win-indicating signal on lead 50 causes the win score counter and decoder/driver circuit 51 to increment the win display panel 53 and to trigger the bonus ticket dispenser logic 54. The number of bonus tickets dispensed is a function of the number of games won in succession.

If the player does not make three baskets, the sensing of the third ball by the ball sensing subsystem 41 or the timing out of the clock 40, whichever is first to occur, disables the basket switch logic 37 and returns the game to a state of readiness for the next player.

If a perfect game is achieved, the game may be reset by reset logic 29 to give the player a free game. For each perfect game attained, up to a maximum of three, the game will automatically recycle with the basket score being reset each time and the win display 53 being incremented. After the third perfect game in a row, however, the reset logic 29 prevents further awards of free games. The game can then be activated only by inserting a coin into the starting switch 27.

Game Sequence Subsystem

Figure 5:
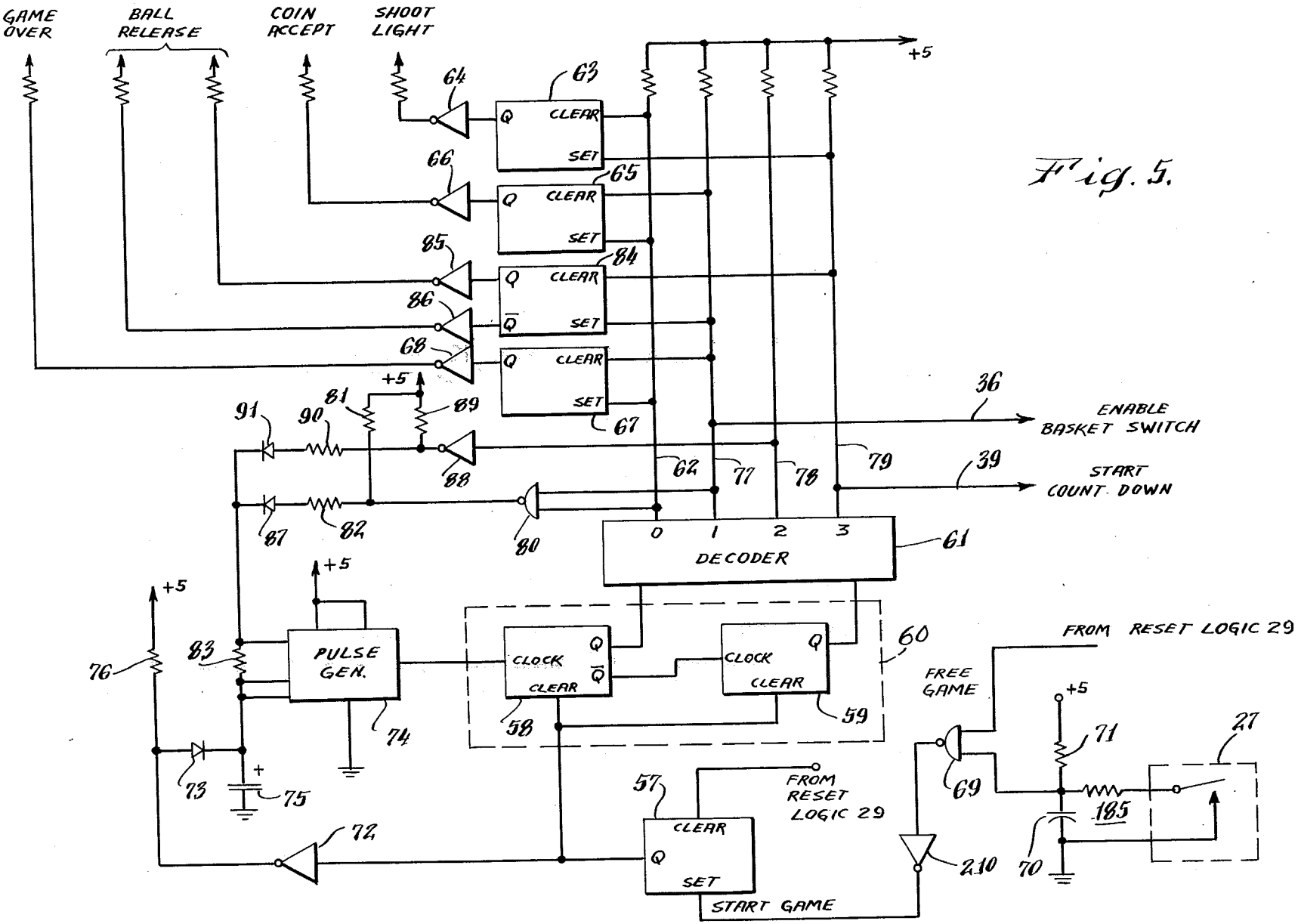
FIG. 5 is a schematic diagram of a game sequence subsystem included within the control system.

Referring now to FIG. 5, the game sequence subsystem generally controls the activation and deactivation of various devices and display lights associated with the game. When power is first applied to the game, reset logic 29 generates a negative going pulse which clears flip-flop 57, driving its Q output to a low level. The leading edge of this low level signal clears a pair of flip-flops 58 and 59 forming a multi-stage binary counter 60. The binary counter 60 provides inputs to a BCD-to-decimal decoder/driver circuit 61 having four possible output states. With flip-flops 58 and 59 both cleared, the decoder 61 causes the normally high output on lead 62 to be driven a low level. The output on the non-selected leads 77, 78, 79 remain high. The low level output on lead 62 clears a Shoot Light flip-flop 63 driving the Q output of that flip-flop to a low level. Signals on the Q output are inverted by an inverter amplifier 64, the output of which provides a control voltage for a triac or similar solid state switching device in the power circuit for the Shoot Light. The high level output from the inverter amplifier 64 causes the Shoot Light to be de-energized. The low level output on lead 62 also drives a Coin Switch flip-flop 65 to a set state in which its Q output is high. The high level Q output from the flip-flop 65 is inverted by an inverter amplifier 66 to provide a low level control voltage for a solenoid-controlling triac associated with the coin-operated switch. The low-level control voltage allows the triac to enable the coin switch to accept inserted coins.

The low-level signal on lead 62 also sets a Game Over flip-flop 67, driving the Q output of that flip-flop to a high level. An inverter amplifier 68 converts the high level output to a low level signal, resulting in the energization of the Game Over light.

The game will remain in this ready-to-play state until a start pulse is applied to the set input of the flip-flop 57. The start pulses are produced by a start gate 69 which is an NAND function gate having normally high inputs from the reset logic 29 and from an charging circuit 185 associated with the coin-operated starting switch 27. When a coin is inserted, the temporarily closed switch 27 forms a discharge path for a previously charged capacitor 70 connected in series with a resistor 71 between a voltage source and ground. The discharge of capacitor 70 produces a negative going pulse at one input to the start gate 69 causing the output of the start gate 69 to go low. The negative going pulse is inverted by inverter amplifier 210 before being applied to the set input of flip-flop 57 to set that flip-flop, driving its Q output to a high level. This high level output from flip-flop 57 is inverted by an inverter amplifier 72 connected to a diode 73 in a control circuit for a pulse generator 74. Diode 73 becomes back biased, effectively connecting capacitor 75 to a charging circuit which includes the diode 73, a resistor 76 and a logic voltage source.

The capacitor 75 is part of a control circuit which drives generator 74 in a astable mode. This control circuit includes a NAND gate 80 having inputs from leads 62 and 77 of the decoder/driver circuit 61. The outputs of the decoder in the ready-to-play or decimal 0 output condition are a low level signal on lead 62 and high level signals on lead 77, 78 and 79. With only one input at a high level, the output of NAND gate 80 is a high level signal. When the output of NAND gate 80 is high, as it is for a decimal 0 output from decoder/driver to enable a charging circuit, including a logic voltage source resistor 81, resistor 82, diode 87 and resistor 83. This charging circuit will tend to charge capacitor 75. However, the charging current is low level, allowing capacitor 75 to initially discharge through resistor 83. When the voltage across the capacitor 75 falls to a predetermined level, pulse generator 74 produces a high level output pulse which sets flip-flop 58. Decoder 61 advances one decimal count, driving the voltage on lead 77 to a lower level while returning the voltage on lead 62 to the normal, high level. The voltage on leads 78 and 79 remain high. The low level voltage on lead 77 clears flip-flop 65 thus inhibiting the coin-operated switch 27, clears flip-flop 67 causing the Game Over light to be extinguished due to the output from inverter amplifier 68 and sets a flip-flop 84 to activate a ball release mechanism through inverter amplifiers 85 and 86. The low level output on the lead 77 also provides an enabling signal on the lead 36 connected to the basket switch logic 37 in the score subsystem 38.

Since the lead 77 carries a low level input to NAND gate 80, the output of the NAND gate 80 remains high during a decimal 1 count. As a result capacitor 75 is recharged by current through resistor 81, resistor 82, diode 87 and resistor 83, all of which form a series circuit with the capacitor 75. When the capacitor has charged to a predetermined voltage, the output of pulse generator 74 goes low, permitting capacitor 75 to discharge through the resistor 83. The pulse generator produces a second pulse when the voltage across capacitor 75 has fallen to a predetermined level. The second pulse resets flip-flop 58, driving its $\overline{Q}$ output to a high level. This high level Q output sets the second flip-flop 59. The decoder 61 decodes these signals as the equivalent of a decimal two causing the voltage on lead 78 to fall to a low level while the voltages on the remaining leads are driven to or remain at a high level.

Since both inputs to the NAND gate 80 are high at a decimal count of two, the low level output produced by that NAND gate back biases diode 87, disabling the charging circuit including resistors 81 and 82 and diode 87.

An inverter amplifier 88 connected to the lead 78 produces a high level output signal which enables a second charging circuit including a resistor 89, a variable resistor 90 and a diode 91, all of which are connected in series with resistor 83. The charging current generated in the second charging circuit is relatively lower than the current produced by the first charging circuit. As a result, the binary counter remains in the decimal two state for several seconds before capacitor 75 charges to a level sufficient to cut off the pulse generator 74. The time delay, which can be adjusted through the use of the variable resistor 90, permits balls to be transported from a ball storage area along a chute to the player. The time delay is also long enough to allow the player time to get ready to shoot the first ball.

At the end of this extended period, the pulse generator 74 produces a third pulse, which sets flip-flop 58 while flip-flop 59 remains in its set state. At this point, the output on lead 79 goes to low level, producing the start signal applied through lead 39 to the countdown clock 40.

The low level output on lead 79 sets flip-flop 63, resulting in the energization of the Shoot Light 34, while clearing flip-flop 84, causing the ball release mechanism 35 to reset in readiness for the next game. Since both inputs to NAND gate 80 and the input to the inverter amplifier 88 are at high levels, the first and the second charging circuits are both disabled. As a result, pulse generator 74 turns off and remains off when capacitor 75 is sufficiently discharged. Consequently, flip-flop 58 and 59 remain set for the duration of the game.

Score Subsystem

Figure 6:
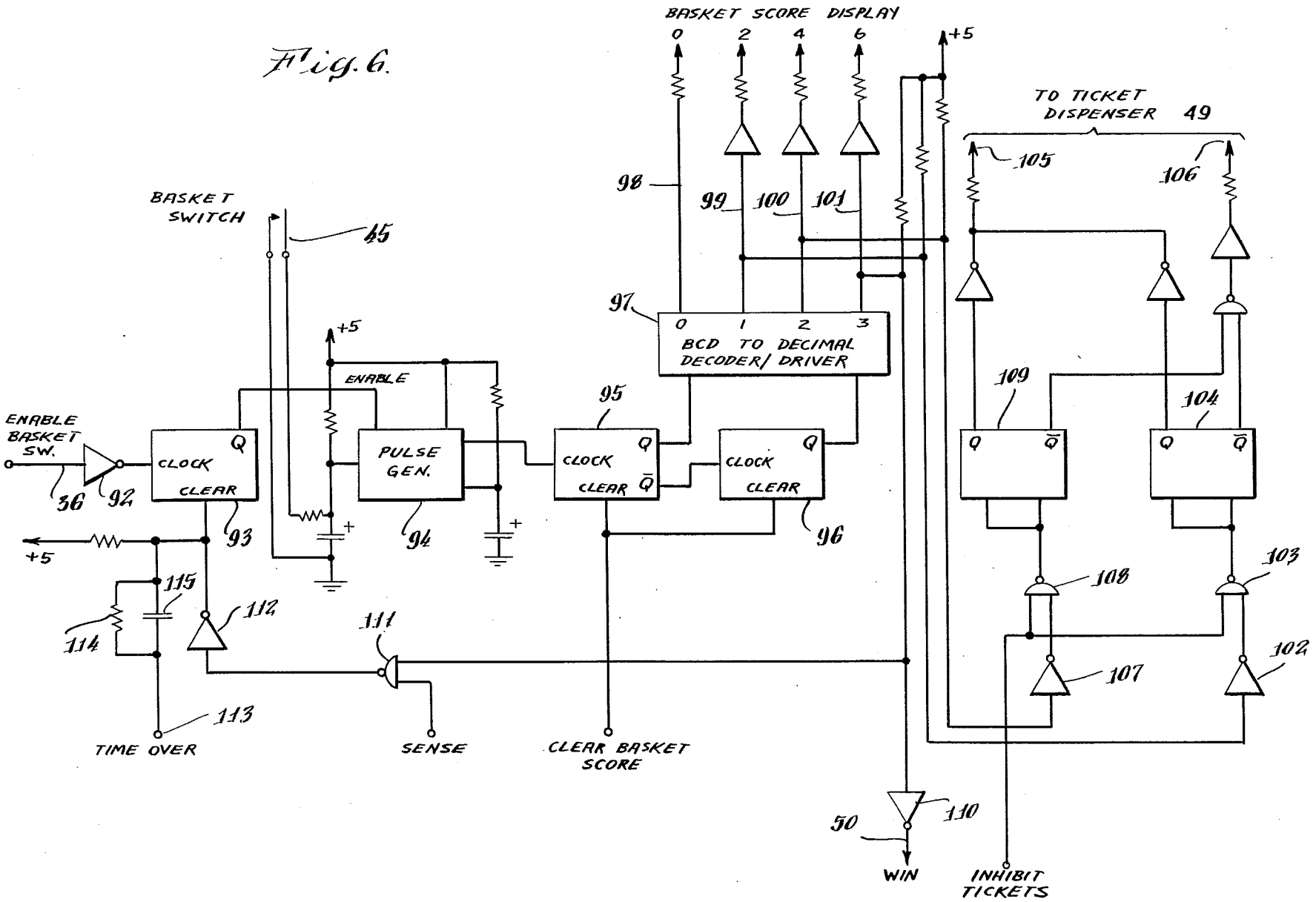
FIG. 6 is a schematic diagram of a score subsystem included within the control system.

Referring now to FIG. 6, the enabling signal on lead 36 is inverted by an inverter amplifier 92 to clock a flip-flop 93 to a set state. The resulting high Q output conditions a pulse generator 94 to be triggered by negative going pulses produced by basket switch 45 each time a basket is scored. The pulse generator 94 remains set for a fixed period of time each time it is triggered so that closely-spaced multiple closures of the switch 45 will not affect the pulse generator 94. Each time the pulse generator 94 is set, a clock signal is delivered to a multistage binary counter consisting of chained flip-flops 95 and 96. The flip-flops accumulate a binary count equal to the number of baskets made in the course of the game. The binary count is decoded in a BCD-to-decimal decoder/driver circuit 97 which drives a basket score display consisting of a panel having lights representing zero to six points. Output leads 98, 99, 100 and 101 are normally high. Each output switches to a low level at a different score under the control of the decoder/driver circuit 97.

The voltage on output lead 99 is inverted by an inverter amplifier 102 in control logic for the ticket dispenser 49. Inverter amplifier 102 provides one input to a NAND gate 103 having a second input labeled as an Inhibit Ticket input. The input is generated in the reset logic 29. If no tickets are to be dispensed, this input is at a low level. If tickets are to be dispensed, this input is fixed at a high level. Assuming tickets are to be dispensed, the positive going pulse produced at the output of inverter amplifier 102 when two points have been scored causes the output of NAND gate 103 to fall to a low level. The negative going output of the gate 103 triggers a one-shot 104. The Q output of the one-shot 104 is inverted to provide a low level signal at one input 105 to the ticket dispenser 49. The already low-level signal on the $\overline{Q}$ output of 104 is inverted to provide a high level signal at a second terminal 106 of the ticket dispenser 49.

If four points are scored in a game, the resulting low level output on lead 100 is inverted by an inverter amplifier 107 to provide a high level input to a NAND gate 108. Since the Inhibit Ticket input to the NAND gate 108 is fixed at a high level, the NAND gate 108 output falls to a low level. This low level output sets a one-shot 109, the outputs of which are ORed with the corresponding output from the one-shot 104. Thus, ticket dispenser 49 is operated momentarily when two points are scored and again when four points are scored in a single game.

If six points are scored in a single game, the game is considered to have been won by the player. Both flip-flop 95 and flip-flop 96 become set. The resulting low level output on lead 101 is inverted by an inverter amplifier 110 to provide a win-indicating signal on lead 50.

Lead 101 at the output of decoder/driver circuit 97 connected to one input of a NAND gate 111 in the basket switch logic. The second input to NAND gate 111 is provided by the ball sensing subsystem 41. When a winning game has been registered or when the third ball is detected, one of the normally-high inputs to the NAND gate 111 will fall to a low level, causing the output of the NAND gate to be driven to a high level. The positive going signal from NAND gate 111 is inverted by an inverter amplifier 112 to produce a negative going pulse at a clearing input for the flip-flop 93. When flip-flop 93 clears, the resulting low level signal at its Q output terminal disables pulse generator 94. Subsequent closures of basket switch 45 are not registered.

Flip-flop 93 can also be cleared by a time over signal produced about two seconds after countdown clock 40. This signal is applied in an input terminal 113 connected to the parallel combination of a resistor 114 and capacitor 115. The two second delay is built in to allow a ball thrown at the end of the fifteen second period time to reach the basket.

Countdown Clock

Figure 7:
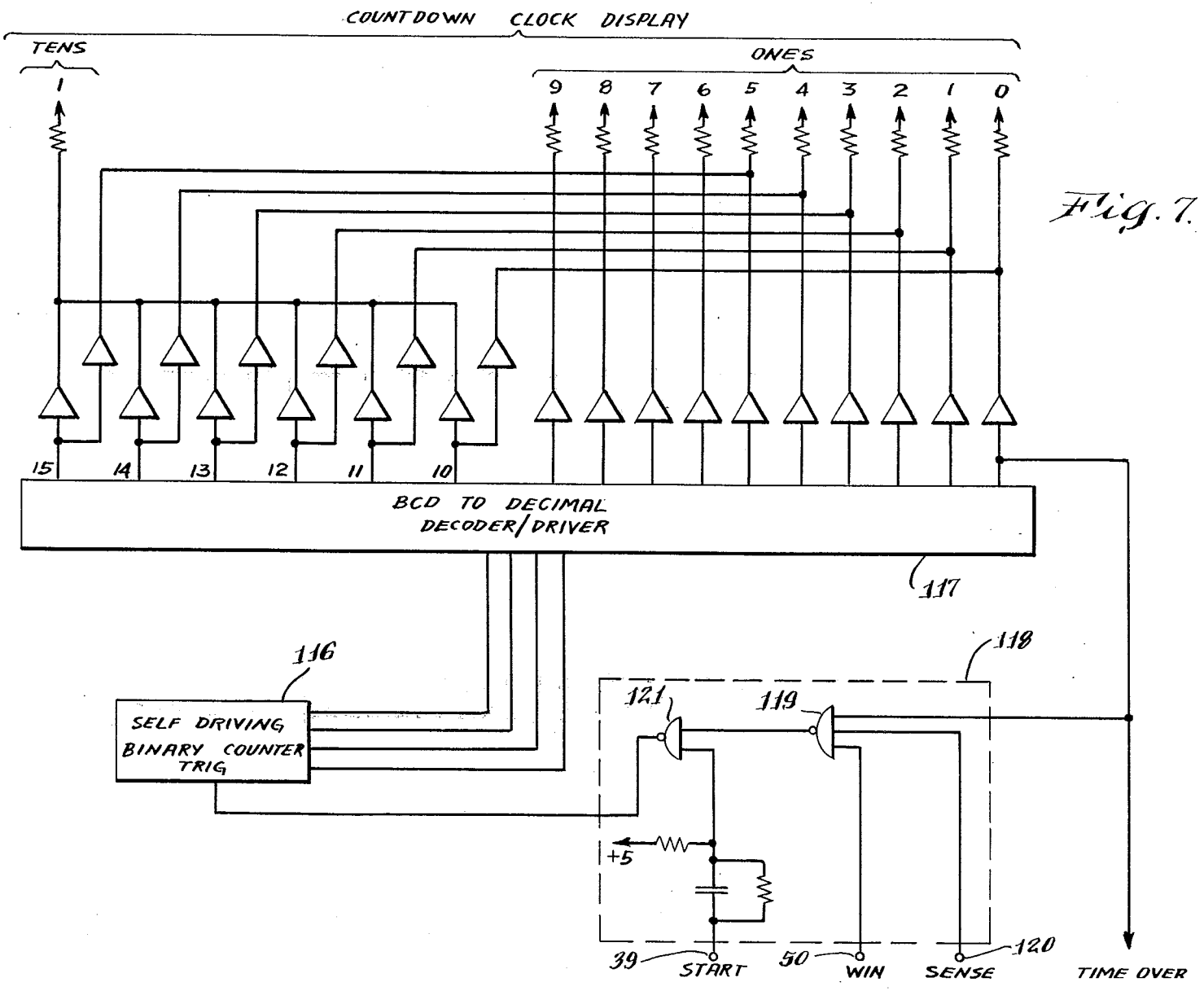
FIG. 7 is a schematic diagram of a countdown clock included within the control system.

The countdown clock illustrated in FIG. 7 includes a self-driving binary counter 116, a BCD-to-decimal decoder/driver circuit 117 connected to the binary counter 116 and control logic 118 for the counter 116.

At the beginning of the game the counter 116 is in a reset state in which all four outputs are high. Under these conditions, all outputs from the decoder/driver circuit 117 except for the zero-seconds output are high. The voltage on the zero-seconds output of the decoder/driver circuit 117 is applied to a NAND gate 119 in the control logic 118. A second input to the NAND gate 119 is provided by the Score Subsystem 38 over a lead 50 which carries a low level signal only when a winning game is registered. A third input to the NAND gate 119 is provided by the Ball Sensing Subsystem 41 over a lead 120. Lead 120 carries a normally high signal which goes low only when the Ball Sensing Subsystem 41 determines that all three balls delivered to a player have been thrown.

At the beginning of a game, the zero-seconds input to NAND gate 119 is low, making its output high. This output provides one input to a NAND gate 121 having a second input from lead 39 of the game sequence logic 32. Lead 39 is normally high, but goes low at the third count of the game sequence decoder/driver circuit 61; that is, when all balls have been delivered and a player has been given time to get ready to shoot. When input 39 goes low, the output of the NAND gate 121 goes high to trigger the binary counter 116. Initially, all outputs from the binary counter 116, except the fifteen-seconds output, to the decoder/driver circuit 117 go low. The binary counter 116 counts through a fifteen second sequence with successively decremented outputs from the decoder/driver circuit 117 being driven temporarily 0 flow levels to change the countdown display of remaining time.

If the Ball Sensing Subsystem 41 does not detect that three balls have been thrown and if the win score counter 51 does not indicate that a perfect game, the decoder/driver 117 will be decremented to the lowest possible level. At the lowest possible level, the voltage on the zero second output of decoder/driver 117 goes low driving the output of NAND gate 119 high. The resulting high level input to NAND gate 121 disables that NAND gate to drive the trigger input of counter 116 low, resetting the counter 116 and the associated display.

If a win is detected before the end of the fifteen second period or if all three balls have been thrown, input 50 or input 120, respectively, to the NAND gate 119 will go low, causing the counter 116 to reset without waiting for the end of the fifteen second period. Thus, the countdown clock 40 is reset upon the first to occur of the following events: (1) the detection that three balls have been thrown, (2) the registration of a perfect score or winning game, or (3) the completed fifteen second count by the clock. The Time Over or high level signal on the zero-seconds output which results is applied to reset logic 29 to ready the game for the next round of play. Details of the reset logic are described later.

Win Score Subsystem

Figure 8:
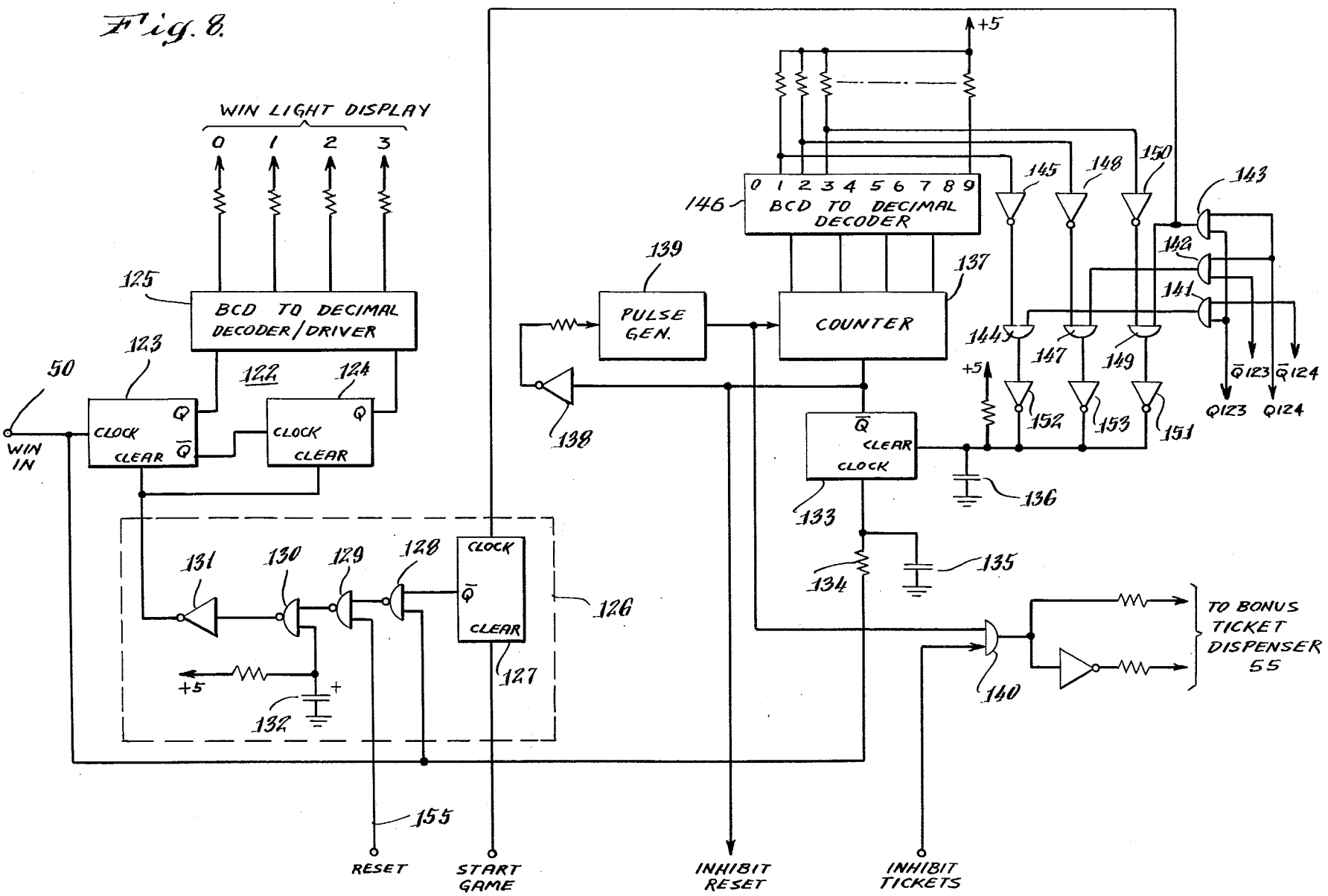
FIG. 8 is a schematic diagram of a win score subsystem included within the control system.

The win score subsystem 52 illustrated in FIG. 8 performs the functions of counting and displaying the number of games a player has won in succession and of dispensing different numbers of bonus tickets depending on that number of games. The subsystem 52 includes a binary counter 122 consisting of a pair of flip-flops 123 and 124. The Q outputs for the flip-flops are connected to a BCD-to-decimal decoder/driver circuit 125 which drives the win display panel 53. The operation of the binary counter is controlled by logic circuitry 126 consisting of a flip-flop 127, a series of NAND gates 128, 129, 130 and an inverter amplifier 131. The binary counter 122, decoder/driver circuit 125, and logic circuitry 126 make up the win score counter and decoder/driver circuit 51 discussed with reference to FIG. 4.

When power is first applied to the game, a pulse generated across a capacitor 132 in logic circuit 126 drives the output of the NAND gate 130 to a high level. This high level signal is inverted by inverter amplifier 131 to clear flip-flops 123 and 124. The flip-flops remain cleared until a positive going signal on input terminal 50 indicates that the perfect game has been scored. Each positive pulse received over input 50 causes the contents of the binary counter 122 to be incremented by one count. Thus, counter 122 stores the number of perfect games played in succession.

The signal on input 50 is also applied to the clock input of a flip-flop 133 in the bonus ticket dispenser logic 54 after a time delay dependent upon the values of a resistor 134 and a capacitor 135 connected to lead 50. The time delay allows certain other inputs to logic 54 time to set before flip-flop 133 can set. The need for this delay is described in greater detail below.

When the flip-flop 133 is driven to a set state by a win signal at its clock input, the resulting low level signal on the $\overline{Q}$ output enables a binary counter 137 and energizes an inverter amplifier 138. Inverter amplifier 138, in turn, provides a high level, enabling signal for a pulse generator 139 which drives the counter 137.

The output of the pulse generator 139 is also applied to an AND gate 140 having a second input from the reset logic. As discussed earlier with reference to the score subsystem 38, the Inhibit Ticket input is normally fixed at a high level assuming a fixed high Inhibit Tickets input, each pulse generated by the pulse generator 139 is gated through AND gate 140 to cause a ticket to be dispensed by a bonus ticket dispenser 55.

The pulse generator 139 is disabled through the operation of logic circuits including AND gates 141, 142, 143 having inputs from the output terminals of the flip-flops 123 and 124. AND gate 141, which produces a high level output when one winning game is registered, provides one input to AND gate 144. The second input to the AND gate 144 is provided by an inverter amplifier 145 connected to the decimal one output of a BCD-to-decimal decoder 146. At the decimal count of one, the input to inverter amplifier 145 goes to a low level. The inverted output of the amplifier 145 is driven to a high level. If one winning game is registered in win counter 122, the output of AND gate 144 rises to a high level. The positive going pulse, when inverted by inverter amplifier 152, clears the flip-flop 133 to disable the pulse generator 139 before a second pulse can be generated.

A AND gate 147, an inverter amplifier 148 connected to decimal two output of the decoder and AND gate 142 and an inverter amplifier 153 operate in a similar manner to disable the pulse generator 139 after two pulses have been generated if two winning games are registered in counter 122. A similar circuit consisting of AND gate 149, an inverter amplifier 150 and the AND gate 143 and an inverter amplifier 151 operates to reset or disable the pulse generator 139 after three pulses are generated where three perfect games are registered.

Thus, the number of bonus tickets which are dispensed is a function not only of the score within the game (since a winning game is needed to win any bonus tickets) but also of the number of winning games played in succession.

It will be noted that the bonus tickets to be dispensed depends on the number of successive winning games, including the winning game which results in the triggering of flip-flop 133. To allow win counter 122 time to set and to establish the states of AND gates 141, 142, 143 in the disabling circuit for the counter 137, the triggering of flip-flop 133 is delayed by the applying of the trigger input through resistor 134 and capacitor 135.

Until the flip-flop 133 is cleared, the high level signal on its Q output not only enables the pulse generator 139 but also inhibits resetting of the game by the reset logic 29. Reset is inhibited to allow the bonus ticket dispenser 55 to dispense all bonus tickets before the game is brought into a state of readiness for the next round of play.

The logic circuit 126 clears the win counter 122 under either of two conditions. The first condition is where the sequence of successive wins is broken by a loss; i.e. something other than a perfect game according to the described embodiment. The second condition is where three games have been won in succession.

The flip-flop 127 is cleared at the start of each game, whether a paid or free game, by a start game pulse provided over lead 31 from the start logic 30. The Q output of the cleared flip-flop 127 presents a high level signal during the game at one input to NAND gate 128. If the game being played is won, the second input to NAND gate 128, applied over input lead 50, will to to a high level at sometime during the game. Assuming less than three games have been won, the output of NAND gate 128 will fall to and remain at a low level as the reset time approaches.

If, however, three games have been won in succession, including the last game played, the high level output of AND gate 143 in the bonus ticket dispenser logic clocks flip-flop 127 before a reset time is reached driving its Q output to a low level. Also, if the most recently played game was not a win, the input provided by lead 50 to the NAND gate 128 remains at a low level.

Under either of these conditions, the output of NAND gate 128 provides a high level input to NAND gate 129. When NAND gate 129 is pulsed by a high level reset pulse over lead 155 from the reset logic 29 a short time after the countdown clock 41 resets, the output of the NAND gate 129 falls temporarily to a low level. The temporary low level output from NAND gate 129, to NAND gate 130, in combination with the fixed high level input from the resistor/capacitor circuit 132, causes the output of NAND gate 130 to rise temporarily to a high level at a loss or after three successive wins. This high level signal is inverted by an inverter amplifier 131 to produce a low level clearing pulse for the flip-flops 123 and 124 causing win counter 122 to reset to zero.

If however, flip-flop 127 is not clocked by the output of AND gate 143, the output of NAND gate 129 will remain high even if a win is recorded causing NAND gate 130 to continue to produce a low level output when the reset pulse is applied. The continued high level output from NAND gate 129 does not result in the clearing of win counter 122.

Ball Sensing Subsystem

One feature of this invention is a logic circuit for detecting the number of balls thrown by a player. As was discussed earlier in some detail with reference to the countdown clock 40, the clock is reset when it is established a player has thrown the number of balls normally delivered during the game cycle. This feature is significant since it prevents a player from using extra balls in an attempt to score a winning game. It is also significant since some players will shoot all of the delivered balls long before the end of the fifteen second period. By resetting the countdown clock 40 when the number of normally delivered balls are counted, the game can be returned to a state of readiness for the next round of play earlier than if the clock must count through an entire fifteen second time period.

Figure 9:
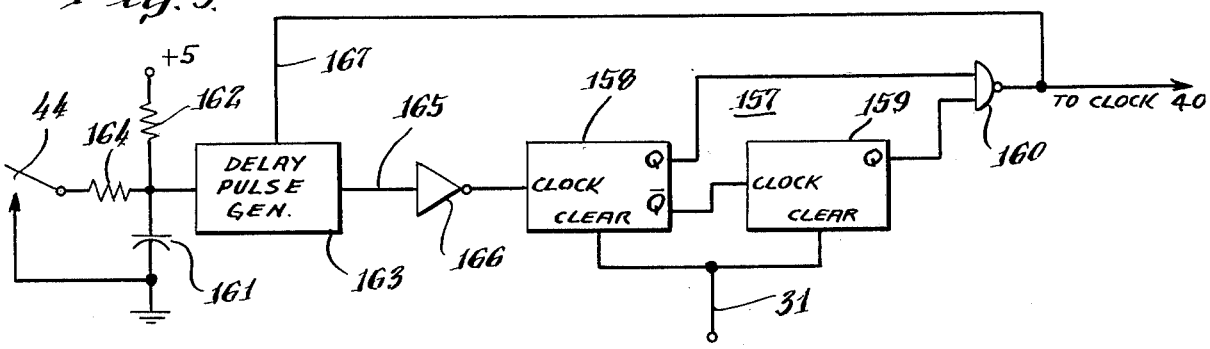
FIG. 9 is a schematic diagram of a ball sensing subsystem included within the control system.

The thrown ball counting subsystem 41 shown in FIG. 9 includes a two stage binary counter 157 consisting of chained flip-flops 158 and 159 having their respective Q outputs connected to the two inputs of a NAND gate 160. The clear terminals of the flip-flops 158, 159 are connected to the output 31 of the start logic 30 and are reset by the start pulse which occurs at the beginning of each game, whether a paid game or a free game.

The binary counter 157 accumulates a binary count representing the number of balls detected by the ball sensing device 44, represented in FIG. 9 as a switch connected across a capacitor 161. The capacitor 161 is connected in series with a resistor 162 between a voltage source and ground and provides a control input to a time delay pulse generator 163. When the switch 44 closes, the capacitor 161 discharges through a resistor 164 connected in series with the switch 44. When the voltage across the capacitor 161 falls to a certain level, pulse generator 163 is triggered to produce a positive going pulse at output 165. The output pulses are inverted by inverter amplifier 166 to clock flip-flop 158.

The binary counter 157 operates conventionally until both flip-flops 158 and 159 are set, indicating three balls have been counted. Under this condition, both inputs to the NAND gate 150 are high, causing that gate to produce a low level output signal. The low level output is applied to the input 120 of NAND gate 119 in the clock control logic described with reference to FIG. 7. As was discussed earlier, this low level signal causes the clock 40 to reset without waiting for the end of the fifteen second period. The low level output of NAND 160 is also fed back to an input 167 for the time delay pulse generator 163 to disable that pulse generator until the next game is started.

Reset Logic

Figure 10:
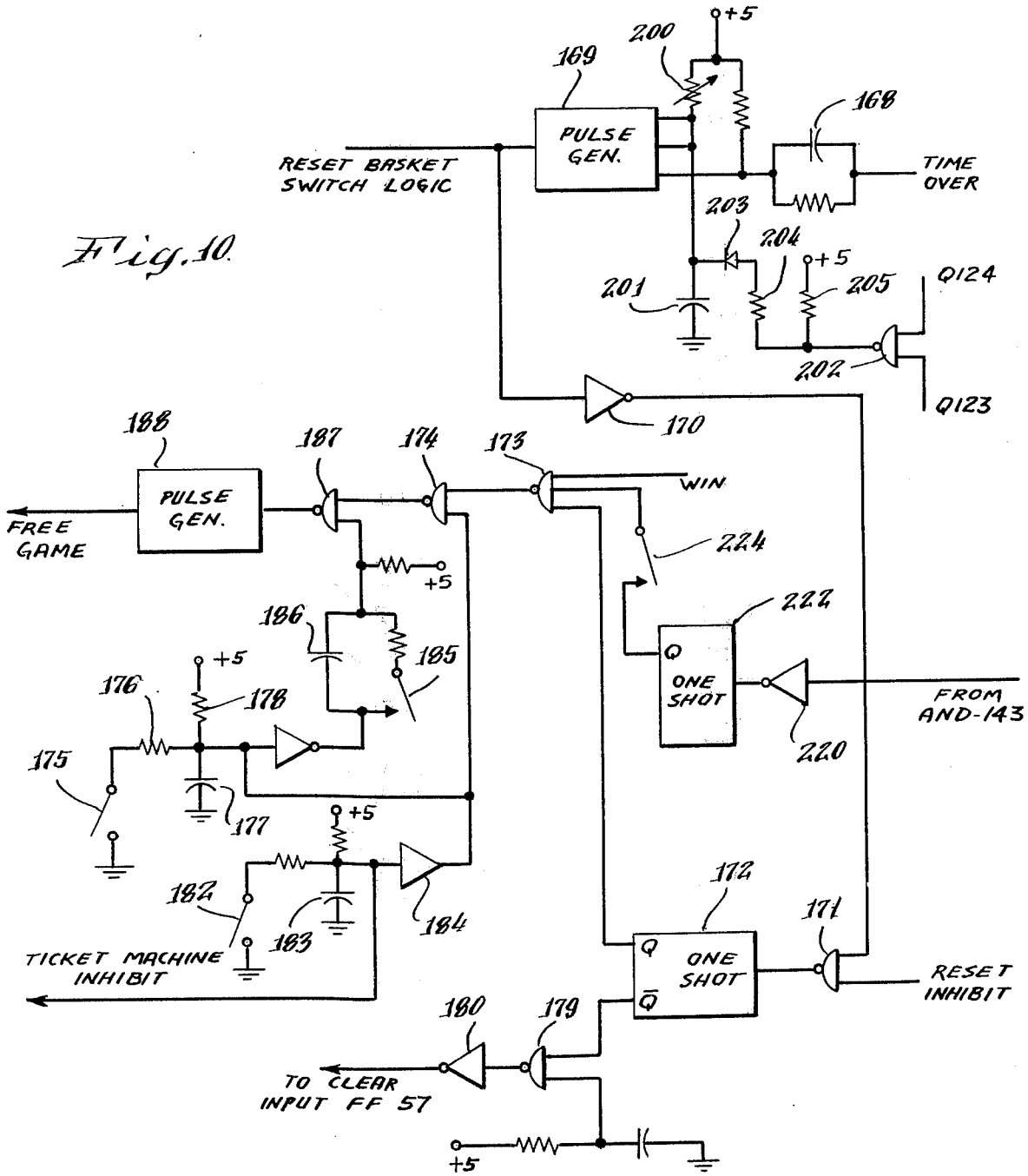
FIG. 10 is a schematic diagram of reset logic included within the control system.

Referring to FIG. 10, reset logic is employed to reset the game and, if either one or two games have been won in succession, to condition the game for a free round of play.

The reset logic is triggered by the resetting of the countdown clock 40. The low level signal appearing on the zero-seconds output of the decoder/driver circuit 117 is applied through a pulse-forming RC combination 168 to a trigger input of a pulse generator 169.

When pulse generator 169 is triggered, its output goes high and a ground is removed from the junction of a variable resistor 200 and a series capacitor 201 forming a charging circuit. The output will go low when voltage across capacitor 201 has built to a predetermined threshhold level.

The rate at which capacitor 201 is charged is a function of the number of registered winning games. If less than three winning games are registered in the win counter 122, one or both inputs to a NAND gate 202 are low in an auxiliary charging circuit for pulse generator 169. The high level output of NAND gate 202 forward biases a diode 203, permitting charging current to flow through resistors 204, 205 and diode 203 to capacitor 201. This charging current is additive to the charging current normally provided through resistor 200 and causes the capacitor voltage to build to the threshhold value about two seconds after the pulse generator 169 is first triggered.

Consequently, for any number of winning games other than three, the output of pulse generator 169 returns to a low level about two seconds after clock 40 is reset. The negative going pulse is applied to the parallel combination of resistor 114 and capacitor 115 in the clear input to flip-flop 93 in the basket switch logic circuit 37. This negative going pulse causes the resetting of the basket switch to be delayed long enough to allow any ball thrown at or near the end of the time period to enter the basket.

The negative going output of pulse generator 169 is inverted by an inverter amplifier 170 to provide a high level input to a NAND gate 171 having a second input connected to the $\overline{Q}$ terminal of flip-flop 133 in the bonus ticket dispenser logic 54. As was discussed earlier, the input from the $\overline{Q}$ terminal will remain low until all tickets which are to be dispensed have been dispensed. When that input goes high, the negative going output from the NAND gate 171 triggers one shot 172. When this occurs, the normally high $\overline{Q}$ output of one shot 172 falls to a low level. As a result, a NAND gate 179, having a fixed, high level second input, generates a high level output signal which, after inversion by an inverter amplifier 180, is applied to the clear input of flip-flop 57 in the start logic to clear the flip-flop in readiness for the next round of play.

When one shot 172 is triggered, the temporarily high Q output partially enables a NAND gate 173 having a second input from the win-indicating terminal 50 of the basket score subsystem 38. If a winning game is recorded, both inputs will have gone to a high level causing NAND gate 173 to produce a low level output signal. This low level output provides one input to another NAND gate 174 which is part of game mode select circuitry.

If free games are to be awarded, an operator will have left open a switch 185 connected across a capacitor 186 in a charging circuit connected to one input of an NAND gate 187. With switch 185 open, a fixed high potential is established at this input. The other input to NAND gate 187 is from NAND gate 174 and is normally low. This input goes to a high level only where a win is detected or where later described auxiliary switches are thrown. If the output of NAND gate 174 does go high, the output of NAND gate 187 is driven to a low level, triggering a one shot pulse generator 188 which supplies a free game pulse to one input of the NAND gate 69 in the start logic 30. This pulse causes the game sequence logic to be triggered as if a coin had been inserted into switch 27.

Where three winning games have been registered, an award of further free games may be prevented at the discretion of a machine attendant. An inverter amplifier 220 in the reset logic accepts an input from AND gate 143 and applies its output to a one shot pulse generator 222. The Q output terminal of pulse generator 222 is tied to one input to NAND gate 173 through a manually controlled switch 224.

If there is to be no limit on the number of free games which may be awarded, switch 224 is left open. The circuitry described will operate to automatically reset the game for free rounds of play after every perfect game. If, however, the maximum number of free games is to be limited, switch 224 is closed. When a high output from AND gate 143 indicates three games have been won in a row, the low-level pulse from inverter amplifier 220 will trigger pulse generator 222. Pulse generator 222 will temporarily reset, driving its Q output to a low level, which disables NAND gate 173. Pulse generator 222 will remain reset long enough to maintain NAND gate 173 in a disabled state when the normally enabling output of one shot 172 is applied. As a result, generation of a free game, pulse will be inhibited.

The game mode select circuitry also permits an operator to manually initiate free games. If an operator wishes to award a free game and to see that tickets are to be dispensed, he temporarily closes a switch 175, discharging a capacitor 177 in a circuit 178. The discharge of the capacitor causes a negative going pulse to be applied to one input of the NAND gate 174. Since the other input to NAND gate 174 is normally high, the negative going pulse from circuit 178 drives the output of NAND gate 174 to a low level. This low level output, in turn, drives the output of NAND gate 187 low to trigger pulse generator 188.

If a free game is to be initiated by an operator but no tickets are to be dispensed, a second key-operated switch 182 may be used. When switch 182 is closed, a negative going pulse at the upper terminal of a capacitor 183 is applied through a high impedance buffer amplifier 184 to NAND gate 174 with the same affect as a pulse provided by circuit 178. However, the negative going pulse at the input to amplifier 184 is also applied to AND gates 103, 108, 140 to inhibit operator of the ticket dispensers.

The various subsystems of the control system described with reference to FIGS. 4–10 cooperate to cause the system to reset the game when the countdown clock 40 times out, when three thrown balls have been detected, or when a winning score has been detected, whichever is first to occur. Upon the occurrence of any three of these events, the game is automatically reset and made ready for the next round of play. Thus, the game does not stand idle as it might if it were cycled for fixed time periods only. On the other hand, the time period established by the countdown clock 40 prevents players from taking too much time to shoot the ball since they do so at the risk of not having late baskets be counted.

Also, the control systems for the ticket dispensers permits the automatic dispensing of tickets as a function not only of the score within the game but of the number of successively won games. The tickets, and particularly the bonus tickets gives players incentive to continue playing the game.

While there has been described what is considered to be a preferred embodiment of the invention, variations and modifications in the embodiment will appear to those skilled in the art once they become familiar with the basic concepts of the invention. Therefore, it is intended that the appended claims shall be construed to include all such variations and modifications as would occur to one skilled in the art.

What is claimed is:

1. For use with a game wherein balls are dispensed to a player who attempts to win the game by throwing a certain number of balls into a target area, a control system comprising:

a. a token-operated switch for producing a start pulse upon insertion of a token;

b. a countdown clock for producing a time over signal at the end of a fixed time period, said clock comprising;

i. a multistage counter for providing a signal at a predetermined count, ii. a pulse source for applying a stream of pulses to said multistage counter, and iii. a clock control circuit having a first input, a second input from said multistage counter and a third input, said circuit being adapted to enable said pulse source in response to a signal on said first input and to disable said pulse source in response to a signal on said second input or a signal on said third input, whichever is first to occur;

c. a thrown-ball sensing subsystem for counting the number of balls actually thrown by the player to generate a third signal to be applied to said clock control circuit when a predetermined number of balls have been counted;

d. a score subsystem for registering the number of balls entering the target area, said score subsystem including an output terminal for carrying a win-indicating output signal;

e. a logic gate connected to said output terminal and to said thrown-ball sensing subsystem and responsive to a win-indicating output signal or to a predetermined thrown-ball count, whichever is first to occur, to inhibit any further registration of balls entering the target area; and f. a game sequence subsystem connected to said thrown-ball sensing subsystem and to said countdown clock, said subsystem being responsive to a predetermined thrown-ball count or to the time-over signal, whichever is first to occur, to reset the game, said game sequence subsystem further including;

i. start logic connected to said token-operated switch and responsive to a start pulse to reset said ball sensing subsystem, and ii. game sequence logic connected to said countdown clock and responsive to a start pulse to generate the pulse source enabling first signal at the end of a time delay period sufficient to permit delivery of the balls to the player.

2. A control system for a game as recited in claim 1 further including reset logic connected to the output terminal of said score subsystem and to said start logic, said reset logic being responsive to a win-indicating output signal to apply a start pulse to said start logic.

3. A control system for a game as recited in claim 2 further including:

a. a win score counter for counting the successive win-indicating output signals appearing on the output terminal of said score subsystem; and b. game-limiting logic circuits connected to said win score counter and responsive to a predetermined count therein to disable said reset logic thereby limiting the number of free games available to a player.

4. For use with a game wherein balls are dispensed to a player who attempts to win each game by throwing a certain number of balls into a target area, a control system for ticket dispensers comprising:

a. a score subsystem for registering the number of balls entering the target area, said score subsystem including;

i. a ball detecting means for producing a score signal each time a ball enters the target area;

ii. A counter having an input from said ball detecting means and outputs representing different scores attainable within a game, one of said outputs carrying a win-indicating signal;

b. a win-score counter connected to the win-indicating output of said score subsystem for counting the number of successive win-indicating output signals;

c. ticket dispenser control logic connected to said score subsystem and to said win-score counter for producing dispenser-actuating output signals as a function of the score attained in the most recent game and of the number of successively won games; and d. mode select circuitry for permitting an operator to inhibit any output from said ticket dispenser control logic.

5. A control system for ticket dispensers as recited in claim 4 wherein said multistage counter further comprises:

a. a multistage binary counter consisting of series-connected flip-flops, the first of which is coupled to said ball detecting means; and b. a decoder having inputs from said binary counter and outputs representing the decimal equivalents of the contents of said binary counter.

6. A control system for ticket dispensers as recited in claim 5 wherein said ticket dispenser control logic further includes bonus ticket dispenser control logic comprising:

a. a pulse source for applying a stream of dispense pulses to a ticket dispenser;

b. logic circuitry for enabling said pulse source upon each win and for disabling said pulse source after generation of different numbers of pulses depending upon the number of games won in succession.

7. A control system for ticket dispensers as recited in claim 6 wherein said logic circuitry further comprises:

a. a multistage counter having output leads representing different counts in a repetitive counting cycle;

b. a plurality of AND gates, each having an input representing a different number of successively won games and an input from a different one of the output leads of said multistage counter.

c. A bistable element having a set input from said win score counter, a clear input from said plurality of AND gates and outputs to said pulse source and to said multistage counter, said bistable element being set by a win-indicating signal to enable said pulse source and said multistage counter and being reset to disable said pulse source and said multistage counter at different counts from said multistage counter, the number of counts being a function of the number of successively won games.

8. For use with a game wherein balls are dispensed to a player who attempts to win each game by throwing a certain number of balls into a target area, a control system comprising:

a. means for resetting the game at the end of a predetermined time period or when a predetermined number of balls have been thrown, whichever is first to occur;

b. means connected to the resetting means for registering the number of balls entering the target area prior to the operation of said resetting means to provide a game score;

c. means connected to said registering means for counting the number of successive games during each of which a predetermined score was attained; and d. means connected to said counting means and to said registering means and responsive to the score attained during the most recent game and to the count in said counting means to actuate coupon dispensers.

* * * * *